United States Patent [19]

Valásek et al.

[11] Patent Number: 4,517,457

[45] Date of Patent: May 14, 1985

[54] DEVICE FOR CONTROL OF LASTING MACHINE FOR SHOE TOES BY GLUING

[75] Inventors: Miloslav Valášek; František Langer; Jaroslav Hrádek; Jindřich Seeman, all of Gottwaldov,, Czechoslovakia

[73] Assignee: Tovarny strojirenske techniky, Prague, Czechoslovakia

[21] Appl. No.: 345,588

[22] Filed: Feb. 4, 1982

[30] Foreign Application Priority Data

Feb. 16, 1981 [CS] Czechoslovakia ..... 1091-81

[51] Int. Cl.[3] ..... A43D 21/00; H01J 5/02

[52] U.S. Cl. ..... 250/239; 12/7

[58] Field of Search ..... 250/561, 239; 12/7

[56] References Cited

U.S. PATENT DOCUMENTS 2,178,609 11/1969 Rohrer ..... 12/7

4,292,529 9/1981 Thurston ..... 250/561

*Primary Examiner*—Edward P. Westin

*Attorney, Agent, or Firm*—Murray Schaffer

[57] ABSTRACT

Photo electric sensors, located in a supporting body, are mounted in association with selected one of the plurality of mold sections in a lasting machine. The photo sensors include a light source and a mirror in one housing and a transistor and a mirror in a second housing. The housing being arranged so that the mirrors transfer the light across the gap between the gap between the plier bodies intersecting the path of movement of the associated clamping jaw. The sensors sense the actual position of the work piece in the mold and provide a signal thereof.

4 Claims, 3 Drawing Figures

DEVICE FOR CONTROL OF LASTING MACHINE FOR SHOE TOES BY GLUING

BACKGROUND OF THE INVENTION

The present invention relates to apparatus for controlling a lasting machine by which shoe toes are glue formed and, in particular, to a photoelectric sensing unit for use in such a system.

The known devices for the control of lasting machines, in which the shoe toes are glue formed, are generally provided with a plurality of different compound levers which are operated by electrical and/or electro-hydraulic devices. The lasting machines are also provided with photoelectric control units so that the mechanisms for bending and fastening of the upper edge of the shoe onto the innersole, as well as the spraying and nailing devices for securing the innersole and the upper together are controlled with photoelectric sensing units. There are other known lasting machines wherein the level of the lasting margin is held to an optimal value by photoelectric marking devices. However, neither of these devices make it possible to control the working cycle of the lasting machine, i.e., the adjustment of the lasting shoe upper on the last to its optimum position, or even the adjustment of the machine for lasting of left and/or right shoes. Further, in the process of adjusting of the shoe in the foregoing known systems, the operator must hold the shoe in both his hands for centering and introduction so that the control levers and switch must be operated by foot and knee controls which are not satisfacotry from the point of safety and hygienic regulation now set for modern industry.

The purpose of the present invention is to develop apparatus for the control of the lasting machine in which shoe toes are formed by glueing, which makes possible the automatic adjustment of the lasting machine for the lasting of right or left shoes and which also makes possible the automatic clamping of the lasting margin of the shoe upper in the lasting system of the machine.

SUMMARY OF THE INVENTION

According to the present invention, the foregoing objects are fulfilled by providing in a lasting machine having a plurality of mold sections, each having a pair of plier bodies and a jaw movable therebetween to hold the work piece, consisting generally of several layers forming the shoe upper a photoelectric sensing units located in supporting bodies which are fastened on the drawing plier bodies. The units comprise a light source and mirror and a miniaturized photo-transistor sensor with a transfer mirror arranged on the level of the clamping parts to intersect the movement of the associated jaws. The sensing units are preferably formed on each of the toe-drawing pliers and on the left and right side drawing pliers opposite the shank part of the shoe.

Further, in accordance with the present invention, the mirrors for the light source, and the sensor of the photoelectric system are mounted on protective shields which are removably set in sockets formed in the supporting body on opposite sides of the respective jaw.

The progress and advantages obtained according to the present invention, wherein the photoelectric sensing units are arranged on the plier bodies themselves makes it possible to automatically arrange the working system of the lasting machine for lasting of left and/or right shoes, and makes it possible to automatically clamp the shoe upper into the drawing plier system of the machine and finally makes possible the automatic lasting of the shoe by the lasting jack. This allows the removal of the normal mechanical or electro-mechanical control levers and switch from the conventional machine. It further reduces the number of operations required to be performed by the operator and enables the highly modern footwear factory to decrease workload and effort expended by the operator of the individual machine. The device according to the present invention furthermore satisfies the very high safety and hygienic regulations required in the industry for the control of the lasting machines. Because the control of the machine does not require manual contact, it is also trouble free from the usual failures caused by the working environment or by the inexperience of the operator. The present invention will become more fully understood from the detailed description given herebelow and from the accompanying drawings, which are given by way of illustration.

DESCRIPTION OF THE INVENTION

Figure 1:
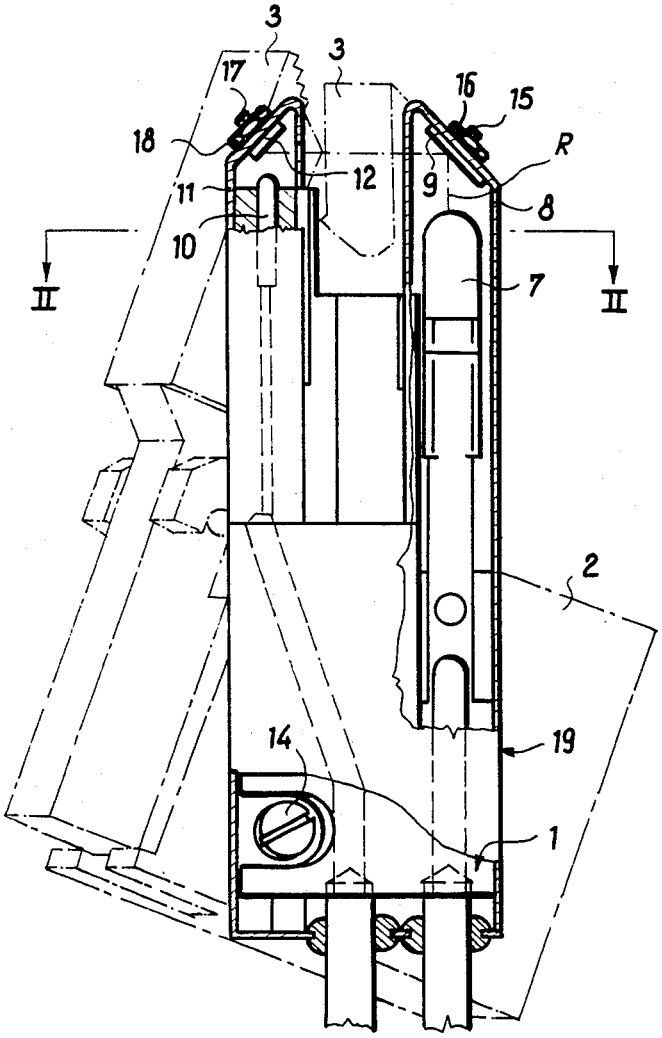
FIG. 1 is a front view of the photoelectric sensing unit of the present invention, partially in section, and shown as mounted on a plier body.
Figure 2:
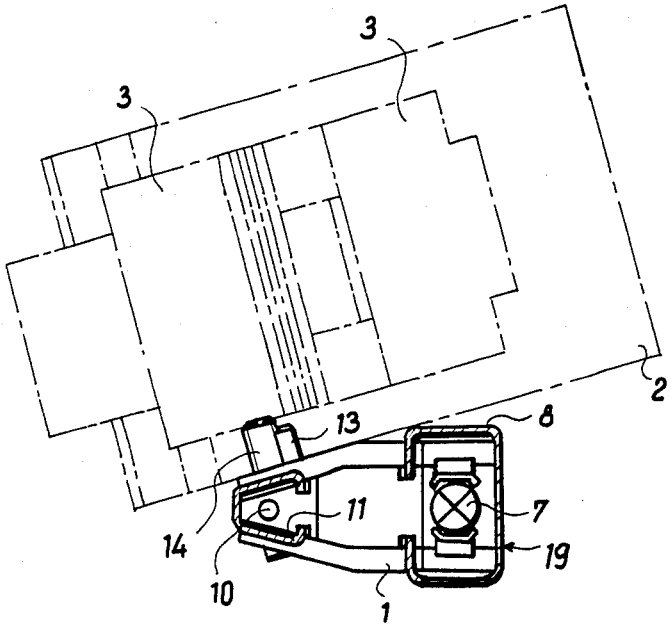
FIG. 2 is a sectional view of the device as shown in FIG. 1 taken along line II—II.
Figure 3:
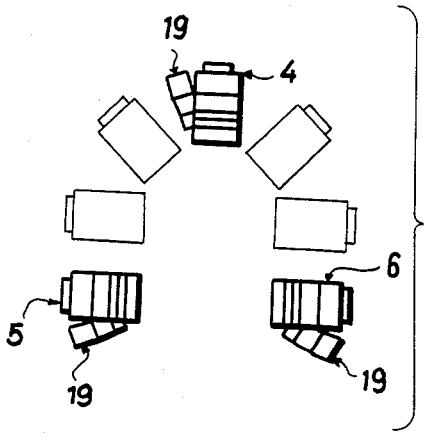
FIG. 3 is a diagrammatic view showing the spatial arrangement of the present invention on a system of drawing applied on a lasting machine.

As seen in FIG. 1, the photoelectric device in the present invention, generally indicated by the numeral 19 is mounted on the sidewall of the desired drawing plier body 2 of the working system of a generally conventional lasting machine for forming, by glueing, the shoe toe. The photoelectric device is mounted on a supporting body 1 and is secured to the body by a pin 13 and a clamping screw 14, which allows for adjustment of the body and the ultimate fixing of the body in the desired position.

The supporting body is provided with sockets for a light source 7 and a light sensor 10 which in this instance is preferably a miniaturized phototransistor. A protective shield 8, having a generally U-shaped form extends upwardly from the supporting socket over the light source 7. A mirror 9 is mounted in the web of the U-shaped protective shield, which web is set at an angle to cause the rays from the light source to be directed across the gap separating the light source from the sensor. The mirror is fixed by a screw 15 and a nut 16. A similar protective shield 11 having a transfer mirror 12 secured thereto by a screw 17 and a locking nut 18 is mounted in the socket, above the light sensor 10. The mirror 12 is set at an angle to receive the rays from the mirror 9 and to direct them onto the light center 10. The path of the light rays is indicated by the dot-dash line R. The light source 7 with its associated mirror 9 and the light center 10 with its transfer mirror 9 form the recognition parts of the photoelectric sensing unit 19. Such photoelectric units are arranged in association with each of the toe jaws 4, and left and right side jaws 5 and 6 so that the rays of a light are carried both on the level of the clamping parts of the drawing plier jaws 3 and on the left and right side of the respective drawing pliers 5–6 opposite the shank part of the shoe.

The photo-sensing device according to the present invention has the following function:

The operator first inserts the lasting margin of the shoe uppers into the photoelectric sensing unit 19 arranged in association with the toe lasting pliers 4. The interruption of the light beam thus creates an impulse capable of initiating operation of the machine. Actually the signal impulse causes operation of the cam shaft, closing the jaws 3 of pliers 4 so that the lasting margin of the shoe upper fits into the drawing pliers. The jaws 3 of the toe-drawing pliers then catch the lasting margin and maintain the upper in position. Thereafter, the lasting margin is inserted sequentially into the left and/or the right side drawing pliers 5 or 6 and the working system of the lasting machine is adjusted for lasting the right and/or left shoe. The photoelectric sensing units 19 are, in fact, connected with conventional control mechanism for operating the spray nozzles, coating of the pliers and lifting of the jacks of the lasting machine so that following the insertion of the side parts of the lasting margin into both the left and right side drawing pliers 5 or 6, an impulse may be provided to automatically operate the control mechanisms through a complete cycle. A lasting margin is kept by the jaws 3 of toe and of the right and left side drawing pliers 5 and 6. Subsequently, the upper is lasted by the lasting jack on the shoe last.

With the grasping of the uppers in the jaws and the automatic operation, the operator's hands become free, so that they are not subject to injury etc. Further, the hands may be used to operate the switches for the machine, thus enabling the machine to be free of foot and knee controls.

Thus, the operator may check the progress of the lasting of the upper because the subsequent operation in the automatic cycle of the lasting machine may be realized with only two push buttons. The operator's attention can be directed fully to the centering of the upper and its last during its insertion into the machine, because the setting of the working system of the machine into operation is purely automatic, as a result of the operation of the photoelectric sensing units 19. The clamping of the lasting margin in the drawing pliers of the machine and the lasting of the upper with the lasting jack is carried out only when the luminous flux in the photoelectric sensing unit is interrupted by the lasting margin of the upper.

We claim:

1. In a lasting machine by which workpieces are assembled into shoes, a plurality of mold sections, each of said sections having a pair of plier bodies and a workpiece engaging jaw operably movable therebetween photoelectric apparatus for sensing the position of said workpiece in at least one of said mold sections and for providing a signal thereof comprising a light source mounted on one of the plier bodies of said at least one mold section, photo transistor mounted on the associated plier body, mirror means arranged to project the light from said source to said photo transistor intersecting the path of the associated jaw between said pliers, said photo transistor adapted to provide an electrical signal on interruption of said light by said workpiece which causes the closing of the associated jaw on said workpiece.

2. The apparatus according to claim 1 wherein said photoelectric sensing apparatus is mounted on and in association with the operation of at least one of a toe, right side and left side mold sections of said lasting machine.

3. The apparatus according to claim 1 wherein each one of the respective light souces and photo transistors are mounted on a supporting socket secured to each associated plier body, each of said light sources and said photo transistors having a protective shield removably fixed to its supporting socket, said mirror means being mounted within each of said protective shields.

4. The apparatus according to claim 3 wherein said mirror means are adjustable.

* * * * *